United States Patent [19]

Hatakeyama et al.

[11] Patent Number: 4,812,064

[45] Date of Patent: Mar. 14, 1989

[54] SHEET SECURING MECHANISM

[75] Inventors: Atsushi Hatakeyama; Masaki Izumi; Seishi Ohmori, all of Tokyo, Japan

[73] Assignee: Eastman Kodak Company, Rochester, N.Y.

[21] Appl. No.: 138,623

[22] Filed: Dec. 28, 1987

[30] Foreign Application Priority Data

Feb. 24, 1987 [JP] Japan ..... 62-40619

[51] Int. Cl.[4] ..... B41J 13/22

[52] U.S. Cl. ..... 400/622; 101/408; 400/523; 24/303

[58] Field of Search ..... 400/120, 523, 527.1, 400/540, 539, 543, 622; 271/18.3; 24/303, 49 M; 269/8, 53, 54.1; 101/408, 382 MV

[56] References Cited

U.S. PATENT DOCUMENTS 3,426,356 2/1969 Zolliker ..... 400/543 X
3,629,905 12/1971 Cote ..... 24/303 X
3,963,229 6/1976 Van Duynhoven ..... 269/8

FOREIGN PATENT DOCUMENTS 1025428 3/1958 Fed. Rep. of Germany ..... 101/408
135176 8/1984 Japan ..... 400/539
240479 11/1985 Japan ..... 400/543

OTHER PUBLICATIONS

Kanno "Document Insertion Device", *IBM Tech. Disc. Bul,* vol. 23, No. 8, Jan. 1981; pp. 3757–3758.

*Primary Examiner*—Clifford D. Crowder
*Attorney, Agent, or Firm*—Raymond L. Owens

[57] ABSTRACT

A sheet securing mechanism which has upper and lower members. Pins are formed on the upper members. A magnetic actuator when excited in one condition provides a magnetic force that causes the upper member to move to a closed sheet securing state where the pins are pressed into a sheet.

1 Claim, 3 Drawing Sheets

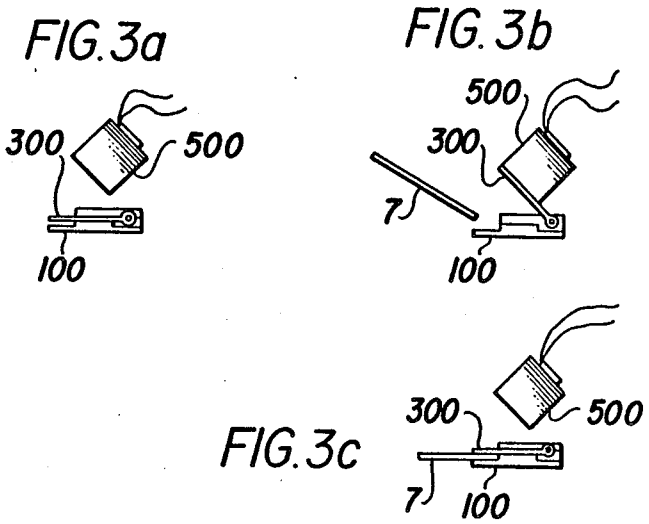
FIG. 3b
FIG. 3c
FIG. 3a
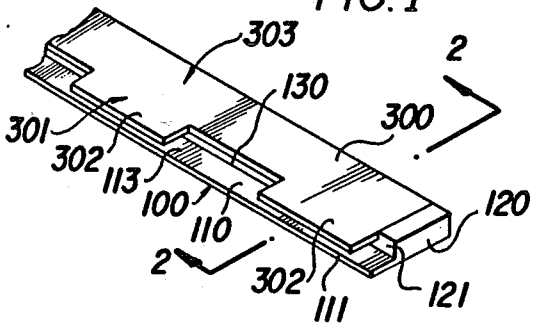
FIG. 1
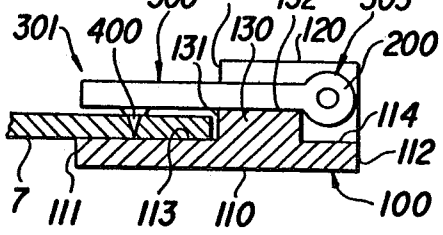
FIG. 2

600
601
610

600
601
400
610

700
701
400
702

700
701
400
710
702

800
801
811
400
810

800
801
811
400
810

SHEET SECURING MECHANISM

FIELD OF THE INVENTION

The present invention relates to a securing mechanism which may suitably be employed in, for example, thermal printers.

BACKGROUND ART

When printing is effected on a predetermined sheet by means of a printer, if the paper is displaced during the printing operation, the print may be blurred. In order to prevent the occurrence of this problem, it is general practice to provide a printer with a sheet securing mechanism which is designed to firmly retain a sheet.

FIGS. 8 and 9 show in combination one example of a conventional paper securing mechanism. In these FIGS., the reference numeral 1 refers to an elongated flap plate-shaped lower base which is fixedly provided on a printer. Flanges 1*a* are provided at two longitudinal ends, respectively, of the lower base 1, and pivot shafts 2 are respectively provided on the flanges 1*a*. The numeral 3 refers to a flat plate-shaped upper arm which is substantially equal in length to the lower base 1, the upper arm 3 being pivotally attached to the lower base 1. More specifically, flanges 3*a* are formed at two longitudinal ends, respectively, of the upper arm 3, and these flanges 3*a* are pivotally supported by the pivot shafts 2 of the lower base 1. One side edge portion 3*b* of the upper arm 3 has a series of projections 3*c* of equal width. An upper friction member 4 is rigidly secured to that surface of each of the projections 3*c* which faces the lower base 1. The other side edge portion 3*d* of the upper arm 3 is slightly bent so as to extend away from the lower base 1.

Springs 5 are respectively fitted on the pivot shafts 2 [see FIG. 9*a*]. The springs 5 bias the upper arm 3 so that the upper friction members 4 are pressed against the lower base 1.

A disc cam 6 is disposed above the side edge portion 3*d* of the upper arm [see FIGS. 9*b* and 9*c*]. Counterclockwise rotation (as viewed in FIG. 9) of the cam 6 causes it to engage with the side edge portion 3*d* of the upper arm 3, thus pushing down the side edge portion 3*d*. More specifically, the rotation of the cam 6 causes the upper arm 3 to pivot clockwise about the pivot shafts 2 against the biasing force of the springs 5 [see FIG. 9*b*]. Thus, the upper friction members 4 which are secured to the side edge portion 3*b* are separated from the lower base 1.

In the state wherein the upper friction members 4 are separated from the lower base 1, the leading edge of a sheet 7 is placed on a portion of the lower base 1 which is directly below the upper friction members 4 [see FIG. 9*b*]. As the cam 6 is further rotated, the upper arm 3 is pivoted counterclockwise by means of the biasing force of the springs 5, thus causing the upper friction members 4 to press the leading edge of the sheet 7 against the lower base 1 [see FIG. 9*c*]. As a result, the edge of the sheet of paper 7 is firmly clamped between the upper friction members 4, and the lower base 1 and rigidly secured by means of friction forces produced between the sheet 7 and the members 4 and the lower base 1.

In order to obtain large frictional force in such a conventional paper securing mechanism, it is necessary to increase the area of the surface used for clamping, that is, the total area of the lower surfaces of the upper friction members 4 and the total area of the portions of the lower base 1 which correspond to the lower surfaces. In other words, the overall size of the mechanism must be increased. In addition, in order to obtain large frictional forces simultaneously, it is necessary to make the springs 5 quite stiff. For this reason, each portion of the mechanism has heretofore been produced by using materials which are sufficiently strong to bear this relatively large spring biasing force. If a print head moving at high speed comes into contact with the mechanism, the head may be damaged.

Generally, the surface condition of sheet changes in accordance with variations in environmental conditions such as temperature and humidity. Accordingly, conventional sheet securing mechanism have a problem in that the frictional force may be lowered considerably due to a variation in the environment so that a sheet of paper cannot reliably be secured.

SUMMARY OF THE INVENTION

In view of the above-described circumstances, it is an object of the present invention to provide a sheet securing mechanism which has reduced overall size and which is capable of reliably securing a sheet in any environment and which is so designed so that it prevents any damage to the print head.

To this end, the present invention provides in a sheet securing mechanism having a pair of upper and lower clamping members for securing a sheet and at least one of said clamping member being adapted to be moved from an open state to a closed sheet securing state. The mechanism further includes spaced sheet retaining pins provided on the clamping surface of at least one of said clamping members so that when said members are in said closed state such pins are pressed into a sheet; and magnetic actuating means selectively excitable in first and second conditions, in said first condition causing said members to be in said open state and in said second condition causing said members to be in said closed state.

A paper securing mechanism according to the present invention may be defined in that at least part of the surface of each of the pair of clamping members if formed from a cushioning material.

BRIEF DESCRIPTION OF THE DRAWINGS

FIG. 1 is a fragmentary perspective view of a paper securing mechanism in accordance with a first embodiment of the present invention;

FIG. 2 is a sectional view taken along the line II—II of FIG. 1;

FIGS. 3*a*, 3*b* and 3*c* are sectional views showing the operation of the paper securing mechanism illustrated in FIG. 1;

DESCRIPTION OF THE PREFERRED EMBODIMENTS

Figures 4A, 4B, 5A, 5B, 6A, 6B:
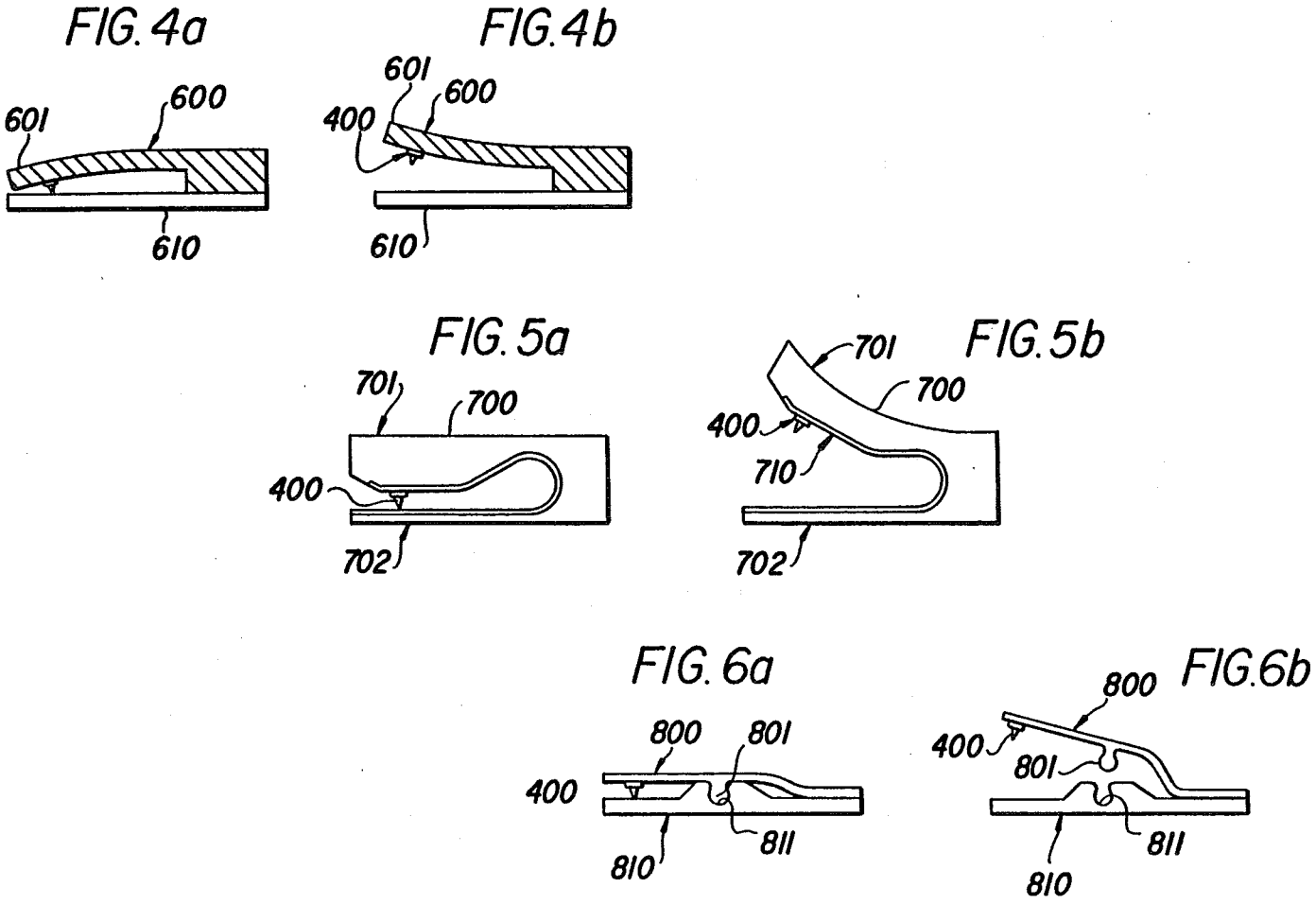
FIGS. 4*a* and 4*b* are sectional views of a paper securing mechanism in accordance with a second embodiment of the present invention.
FIGS. 5*a* and 5*b* are sectional views of a paper securing mechanism in accordance with a third embodiment of the present invention.
FIGS. 6*a* and 6*b* are sectional views of a fourth embodiment of the present invention.

Embodiments of the present invention will be described hereinunder with reference to the accompanying drawings. Referring first to FIG. 1, the reference numeral 100 refers to a lower base which is fixedly provided on a printer (not shown) and which has a bottom plate portion 110 in the shape of a continuous flat plate. End walls 120 are respectively formed on the upper surfaces of two longitudinal end portions of the bottom plate portion 110, each end wall 120 extending laterally on the bottom plate portion 110 from the substantially central portion in the side wise direction of the bottom plate portion 110 toward one side edge 112 thereof. A ridge or elongate projection 130 which has a rectangular cross-section is formed on the upper surface of the bottom plate portion 110. The ridge 130 has a height slightly greater than the thickness of a sheet of paper 7. The ridge 130 is disposed in substantially central portion in the widthwise direction of the bottom plate portion 110 and slightly closer to the side edge 112, and one wall portion 131 of the ridge 130 is aligned with an imaginary line extending between one of the end faces 121 of each end wall 120. The ridge 130 which is thus disposed in the substantially central portion in the widthwise direction of the bottom plate portion 110 divides the upper surface of the bottom plate portion 110 into two portions in the direction of the width of the bottom plate portion 110, that is, into upper surface portions 113 and 114.

The lower base 100 has an integral structure consisting of the above-described bottom plate portion 110, end walls 120 and ridge 130, which are formed integrally with each other and are made from a relatively flexible and light-weight material in a molding process. Further, the lower base 100 is magnetized.

The end walls 120 of the lower base 100 support a pivot shaft 200 that is disposed above the upper surface 114 of the lower base 110 in such a manner that the shaft 200 extends parallel to the surface 114 of the lower base 100 at a position which is slightly above the upper surface 132 of the ridge 130.

The reference numeral 300 refers to an upper arm in the shape of a continuous plate. The length of the upper arm 300 is substantially equal to the distance between the end walls 120 of the lower base 100. The width of the upper arm 300 is substantially equal to the width of the lower base 100. A series of equally spaced rectangular projections 302 are formed along one side edge portion 301 of the upper arm 300. The depth of these projections on the edge portion 301 is equal to the width of the upper surface 113 of the lower base 100. The other side edge portion 303 of the upper arm 300 is formed in the shape of a sleeve over the entire length thereof. This edge portion 303 is pivotally fitted on the above-described pivot shaft 200. In consequence, the upper arm 300 can pivot about the shaft 200 so that the arm 300 either abuts against the upper surface 132 of the ridge 130 (a closed state) or is separated from the lower base 100 (an open state). In the closed state, the upper arm 300 is disposed parallel with the lower base 100 and the distal end of each projection 302 of the upper arm 300 is aligned with a side edge 111 of the lower base 100. In this closed state, a sheet of paper 7 (see FIG. 2) is clamped between the lower base 100 and the upper arm 300 in such a manner that the sheet 7 is placed on the upper surface 113 with the end face of the leading edge thereof abutting against the wall portion 131.

The upper arm 300 is formed from a relatively flexible and light-weight material. The upper arm 300 is magnetized so that the upper arm 300 and the lower base 100 attract each other. Alternatively, the lower base 100 could be magnetized.

A pin 400 is secured to the lower surface of each projection 302 of the upper arm 300. The lower surface of the projection 302 is that surface which faces the lower base 100 (see FIG. 2). The pin 400 has a length which is substantially equal to the thickness of the sheet of paper 7. When the mechanism is in a closed state wherein the sheet 7 is clamped between the lower base 100 and the upper arm 300, the pin 400 is pressed into the sheet 7 securing the same.

An electromagnetic actuator 500 is provided at a predetermined angle of inclination above the upper arm 300 (see FIG. 3). The actuator 500 is selectively excited in opposite conditions or directions. More specifically, when the actuator 500 is excited in a condition or direction in which it attracts the upper arm 300 with a magnetic attraction force which is stronger than the continuous magnetic attraction force between the lower base 100 and the upper arm, the upper arm 300 pivots clockwise as viewed in FIG. 3 and is electromagnetically held on the actuator 500 [see FIG. 3*b*] in an open state. When the actuator 500 is excited in a condition or direction in which it repels the upper arm 300, the arm 300 which has been held on the actuator 500 is electromagnetically biased so as to pivot counterclockwise as viewed in FIG. 3 and thereby caused to be attracted by and held on the lower base 100 in a closed state.

With the above-described arrangement, before a sheet 7 is to be clamped, the electromagnetic actuator 500 is excited so as to attract the upper arm 300. In consequence, the upper arm 300 is pivoted clockwise about the shaft 200 despite the magnetic attraction force between the base and upper arm and is electromagnetically held on the actuator 500. The mechanism is thus brought into an open state. In this state, the sheet 7 is delivered (by means not shown) on to the upper surface 113 of the lower base 100. At this time, the end face of the leading edge of the sheet 7 is brought into contact with the wall portion 131, thereby positioning the sheet 7 in place.

Then, the actuator 500 is excited in the opposite direction. The upper arm 300 is electromagnetically biased and pivots counterclockwise so as to come into contact with the upper surface 132 of the ridge 130. The mechanism is thereby moved into a closed state. In this closed state, the sheet 7 is clamped between the upper arm 300 and the lower base 100 and, at the same time, the pins 400 are pressed into the sheet 7 so as to secure the same. Since the upper arm 300 and the lower base 100 magnetically attract each other, the closed state is reliably maintained.

FIG. 4 shows a paper securing mechanism in accordance with a second embodiment of the present invention. The second embodiment differs from the above-described first embodiment in that the upper arm 600 is formed from elastic, deflectable material and is secured directly to the lower base 610. More specifically, the upper arm 600 has an L-shaped cross-sectional configuration, and when the mechanism is in a closed state, a clamping end portion 601 of the arm 600 is deflected so as to come into contact with the lower base 610 by the magnetic attraction force acting between the upper arm 600 and the lower base 610. As a result, a sheet is clamped between the upper arm 600 and the lower base 610 and, at the same time,the sheet is secured by means of the pins 400.

FIG. 5 shows a paper securing mechanism in accordance with a third embodiment of the present invention. The third embodiment differs from the above-described second embodiment in that the upper arm 701 and the lower base 702 are formed integrally with each other. More specifically, the paper securing mechanism in accordance with this embodiment is arranged such that a leaf spring 710 which is bent so as to be in the shape of a letter U is rigidly secured to the inner side of a cushioning material 700 that also has the shape of a letter U. The spring 710 urges the upper arm 701 to the open state.

FIG. 6 shows a paper securing mechanism in accordance with a fourth embodiment of the present invention. The fourth embodiment differs from the above-described first embodiment in that the upper arm 800 is formed from an elastic material and is secured directly to the lower base 810. The upper arm 800 and the lower base 810 are respectively provided with a projection 801 and a recess 811 which is adapted to receive the projection 801. In this embodiment, when the mechanism is in a closed state, the projection 801 is in engagement with the recess 811, thereby providing alignment means enabling the lower base and upper arm to be in the same relative position after repeated operations.

Figure 7A:
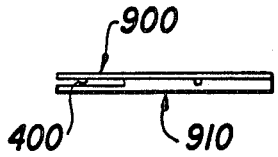
FIGS. 7*a* and 7*b* are sectional views of a fifth embodiment of the present invention.
Figure 7B:
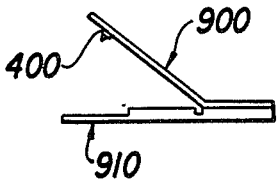
Figure 9A:
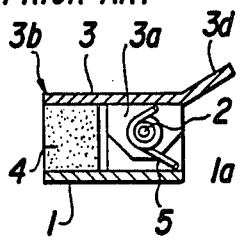
FIG. 9a PRIOR ART
FIGS. 9*a*, 9*b* and 9*c* are sectional views taken along the line IX—IX of FIG. 8, which show the operation of the conventional sheet securing mechanism.
Figure 9B:
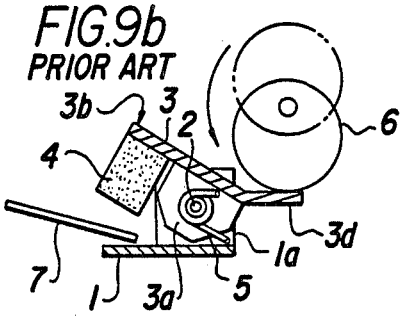
FIG. 9b PRIOR ART
Figure 9C:
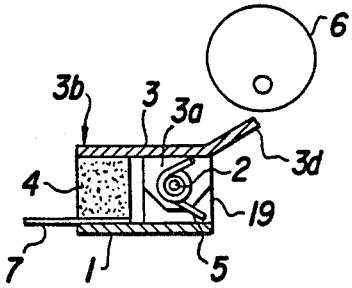
FIG. 9c PRIOR ART
Figure 8:
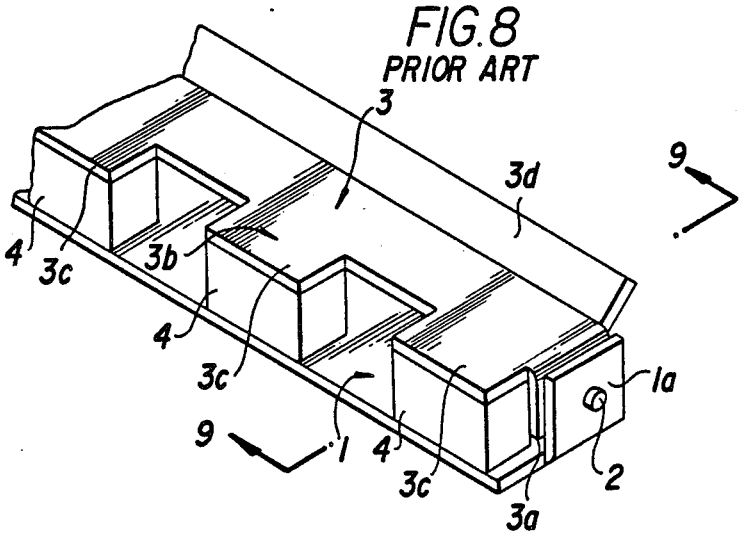
FIG. 8 PRIOR ART
FIG. 8 is a fragmentary perspective view of a conventional sheet fragmentary perspective view of a conventional sheet securing mechanism.

FIG. 7 shows a paper securing mechanism in accordance with a fifth embodiment of the present invention in which the upper arm 900 and the lower base 910 are bonded to each other. In this arrangement, the pivot shaft 200 which is employed in the first embodiment shown in FIGS. 1 to 3 is eliminated.

As has been described above, the present invention provides a paper securing mechanism having a pair of clamping members for clamping a sheet of paper therebetween, said pair of clamping members being activated to open and close by magnetic actuating means and wherein either one or both of the pair of clamping members are magnetized so as to provide an attraction force between each other, and paper retaining pins are provided on the clamping surface of either one or both of the pair of clamping members. Accordingly, unlike the conventional paper securing mechanism that utilizes frictional force to secure a sheet of paper, the present invention enables a sheet of paper to be secured by pins and permits this secured state to be maintained by means of the magnetic attraction force acting between the clamping members, so that it is possible to reliably secure the sheet of paper at all times independent of any change in environmental conditions such as temperature and humidity. In addition, since there is no need for any frictionl surfaces as needed in the prior art, it is possible to reduce the size of the mechanism.

Further, if at least the surface of each of the pair of clamping members is at least in part of a cushioning material, the cushioning material is able to absorb any impact resulting from contact with the print head, so that it is possible to prevent any damage to the print head by contact between the head and the clamping members.

The invention has been described in detail with particular reference to certain preferred embodiments thereof, but it will be understood that variations and modifications can be effected within the spirit and scope of the invention.

We claim:

1. In a sheet securing mechanism having a pair of upper and lower clamping members for securing a sheet and with one of said clamping member being adapted to be moved from an open state to a closed sheet securing state, the improvement comprising:

a. spaced sheet retaining pins provided on the clamping surface of at least one of said clamping members so that when said members are in said closed state such pins are pressed into a sheet;

b. magnetic actuating means including a magnetic actuator selectively excitable in first and second conditions, in said first condition causing said members to be in said open state and in said second condition causing said members to be in said closed state; and c. alignment means for maintaining the same relative position of said upper and lower members each time after the movable clamping member is moved to said closed state including a non-sheeting engaging projection provided on one of said member and said other member defining a recess for receiving said projection when in said closed state.

* * * * *